United States Patent [19]

Larsen

[11] Patent Number: 4,657,251

[45] Date of Patent: Apr. 14, 1987

[54] SPORT IMPLEMENT SWING TRAINING METHOD

[76] Inventor: Erling A. Larsen, 2020 S. Columbus, No. 402, Tucson, Ariz. 85711

[21] Appl. No.: 701,865

[22] Filed: Feb. 14, 1985

[51] Int. Cl.[4] ..... A63B 69/40

[52] U.S. Cl. ..... 273/26 C; 273/183 B; 273/189 R; 273/54 B

[58] Field of Search ..... 273/54 B, 183 B, 186 R, 273/186 C, 189 R, DIG. 30, 25, 26 C, 54 BA; 2/273, 16, 117; 119/106, 108; 128/327

[56] References Cited

U.S. PATENT DOCUMENTS

| | | | |
|---|---|---|---|
| 1,473,041 | 11/1923 | Henderson | 128/327 |
| 1,956,201 | 4/1934 | Roberts | 273/54 B |
| 2,949,610 | 8/1960 | Lutsky | 2/16 |
| 3,123,832 | 3/1964 | Kubik | 273/54 B |
| 3,413,000 | 11/1968 | Alkonis | 273/54 B |
| 3,504,379 | 4/1970 | Glick | 2/16 |
| 3,586,001 | 6/1971 | Sanderson | 128/327 |
| 4,149,540 | 4/1979 | Hasslinger | 128/327 |
| 4,323,232 | 4/1982 | Terpening | 273/183 B |
| 4,479,495 | 10/1984 | Isaacson | 128/327 |

*Primary Examiner*—Richard C. Pinkham

*Assistant Examiner*—T. Brown

*Attorney, Agent, or Firm*—Cahill, Sutton & Thomas

[57] ABSTRACT

This invention relates to a method of utilizing a training aid for aiding a person in maintaining proper orientation of a person's hand while holding a sports implement. The training aid is comprised of an elastic wristband which includes a narrow strip or patch of Velcro material secured to the inner surface thereof. When training a right-handed athlete in proper swinging of a baseball bat, the wristband is worn on the athlete's left wrist, with the Velcro patch positioned over and pressed against the athlete's skin covering the "leading" end of his wrist bone. The Velcro produces a stimulation of the skin, due to relatively sharp points of the Velcro material. This directs the athlete's attention to the location of the sensation enabling him to concenctrate on that point and "aim" it as he swings the bat, thus enabling him to avoid erroneous "rolling" of his wrist during the swing before contact between the bat and a baseball. The wristband is also useful in training an athlete to maintain proper orientation of his wrist during the sequence of motions required for throwing a baseball, swinging a golf club, and during throwing of a bowling ball.

9 Claims, 8 Drawing Figures

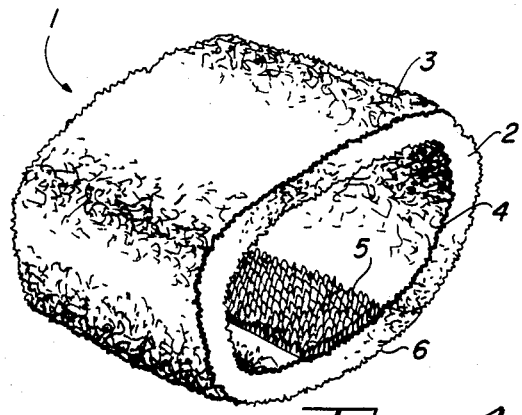
FIG. 1
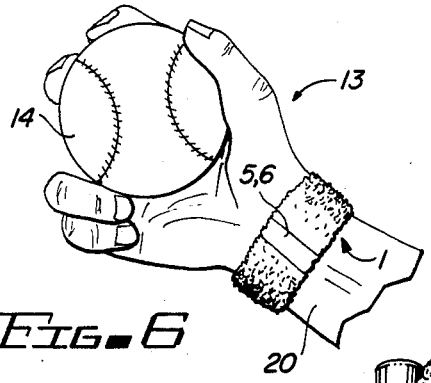
FIG. 6
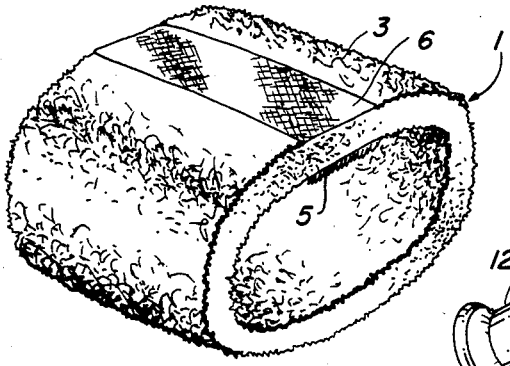
FIG. 2
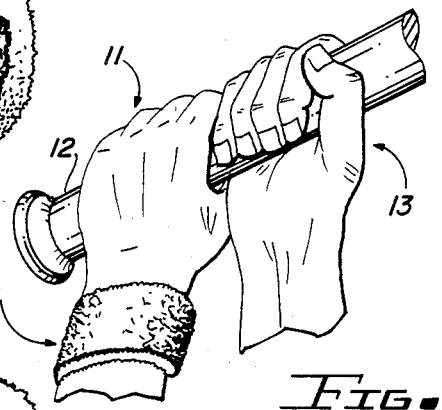
FIG. 7
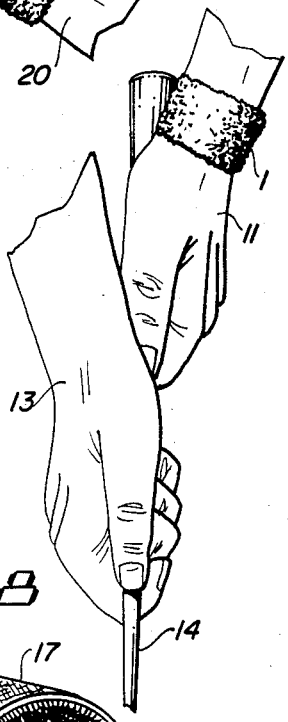
FIG. 8
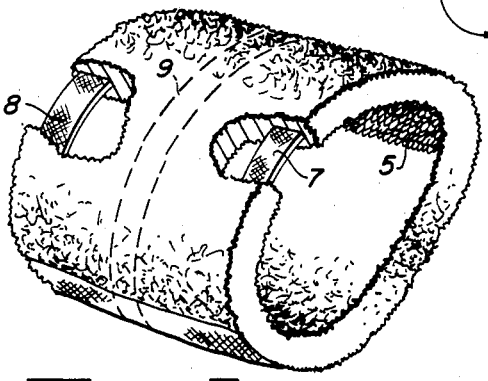
FIG. 3
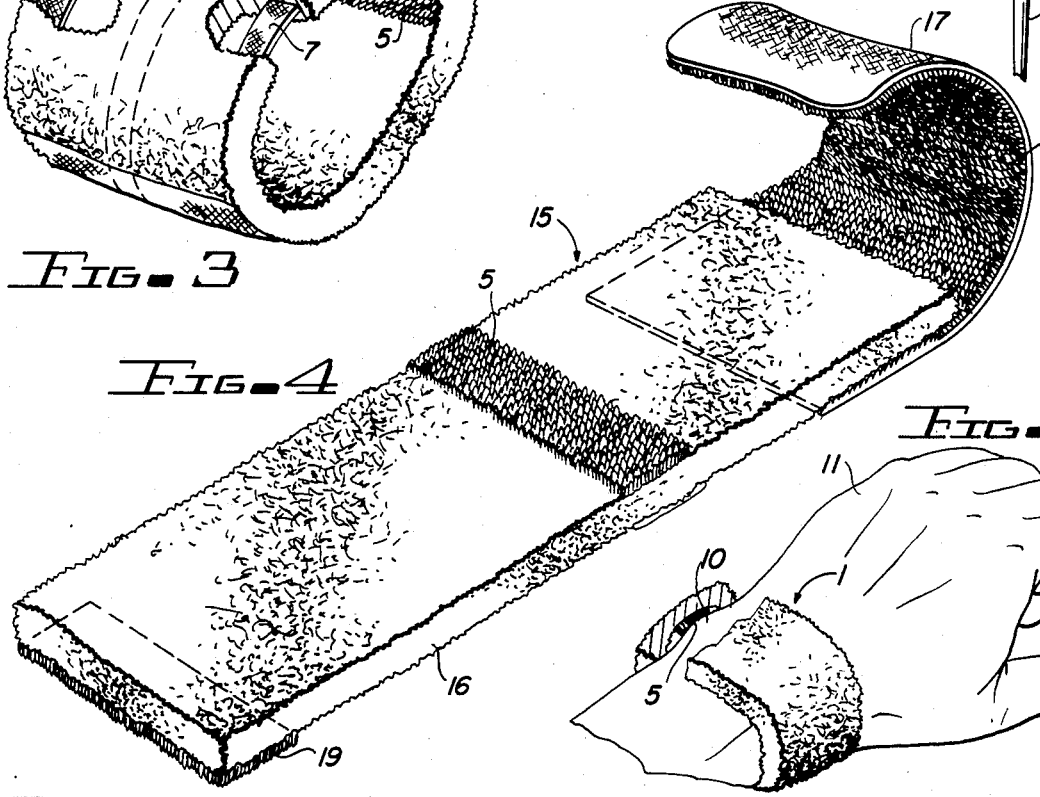
FIG. 4
FIG. 5
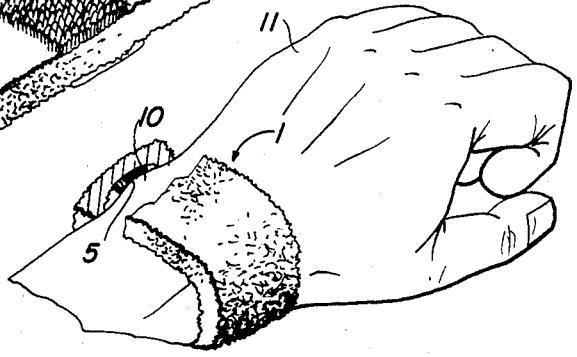

SPORT IMPLEMENT SWING TRAINING METHOD

BACKGROUND OF THE INVENTION

Coaches, "pros" and other sports trainers know that it is very important for an athlete to maintain the proper orientation of one or both of his or her wrists and hands during the sequence of motions required for proper swinging of a baseball bat, swinging of a golf club, using a golf putter, during throwing of an overhand "fast ball", and during the swing and release of a bowling ball. In the case of the propering swinging of a baseball bat or a golf club, it is important for a right-handed athlete not to "roll" the wrist of his or her left or "lead" hand as it grips the baseball bat or golf club during the swing. Coaches frequently emphasize to their students that the "lead" end of the wrist bone of the left hand should continue to "point" or be aimed in the direction of the arc of the swing of the baseball bat or the golf club, and that in properly "leading" of the swing with the "lead" end of the wrist bone during the swing, the person's entire body is caused to almost automaticaly go through the proper sequence of motions to result in a good swing. However, baseball players and golfers frequently experience difficulty in focusing their attention on the direction in which the "lead" end of their left hand wrist bones point during the swing of a bat or golf club because there are so many other matters on which they must also mentally concentrate in order to achieve a perfect swing. Sports trainers, coaches, etc., and also atheletes recognize that the mental aspects of sports that require precision swinging of an arm and/or a "club" such as a baseball bat or a golf club are very important, but it is frequently difficult for them to focus adequate attention on the swing of the arm or the movement of the wrist, etc.

A main mistake that many (right-handed) persons make, despite being instructed to the contrary, is to improperly use their right hand to "push" the bat or club through the swing, rather than properly "lead" or "pull" the bat or club through the swing with the left hand while performing a circular or twisting motion of the upper body that causes the left arm and hand to "pull" the bat or club. This mistake is made so commonly by right-handed persons because they are accustomed to using their right hands in a dominant fashion in most of their activities, and despite intensive training and coaching, it is very easy to lose mental concentration and often repeat the mistake. When the mistake of pushing the bat or club is made, it results in lateral, rather than circular motion of the person's upper body, causing lateral motion of the head. This in turn causes loss of hand/eye coordination and loss of accuracy of the swing.

SUMMARY OF THE INVENTION

Accordingly, it is an object of the invention to provide a method which enables an athlete to easily focus his or her concentration on the orientation of his or her wrist during swinging of a baseball bat, a golf club, or the like, or during throwing of a ball.

It is another object of the invention to provide a method for focusing an athlete's concentration upon the movement of his or her wrist which is inexpensive, easily used, and which does not interfere with other aspects of the swinging of a baseball bat, golf club, etc., or of the throwing of a ball.

Briefly described, and in accordance with one embodiment thereof, the invention provides an elastic wristband and a strip or patch of Velcro material attached to the inner surface of the elastic wristband such that when the elastic wristband is being worn, the Velcro strip can be positioned to stimulate the point of the user's wrist which is to be "pointed" or "aimed" in a certain direction during swinging of a baseball bat or golf club, or during the throwing of a baseball or the like, and thereby help the user focus mental attention on maintaining proper orientation of his or her wrist. In using the skin stimulating wristband of the invention in training an athlete to perform a proper swing of a baseball bat or a golf club, the Velcro strip is positioned so that it covers the "lead" end of the wrist bone of the athelete's left hand, assuming that the athlete is right-handed and is performing a right-handed swing. The "points" of the loops and hooks of the Velcro poke into the person's skin over the slightly protruding "lead" end of the wrist bone, producing a small amount of pain or stimulation which the athlete readily notices. The coach or trainer instructs the athlete to "aim" the part of the wrist at which the stimulation of the Velcro patch is felt so that it (the location of the sensation) moves through the plane of the arc of the desired swing.

To use the wristband to aid in throwing of an overhand "fast ball", the wristband is placed on the (right-handed) pitcher's right hand, and the Velcro strip is positioned along the relatively flat inner surface of his wrist adjacent to the palm of his right hand. To instruct the user to perform a proper "windup", the coach or trainer instructs the pitcher (right-handed) to pivot his body clockwise (as viewed from above), lift his left knee upward toward the middle of his chest, and at the same time extend the right hand and the baseball straight out and rearward to a point below the waist level and then up to a level halfway between the shoulder level and waist level, so that the Velcro strip and sensation produced thereby is aimed downward at the ground. This ensures maximum possible extension of the pitcher's arm, and a maximum arc of the arm and the ball during the next phase of the throwing motion. The pitcher then points the toes of the left foot at the target as he lowers his left foot solidly on the ground in front of the pitcher's mound, rotating the hips, shoulders, and upper arm counterclockwise and forward, with the forearm, right hand and baseball lagging behind. As the motion progresses, the arm action is much like that of a slingshot, and the hand and baseball are delivered past and above the head level. The coach or trainer instructs the athlete to aim the area of skin sensation produced by the "pointed" Velcro hooks and loops forward toward the target at this point of the throwing motion. The fact that this technique causes the hand and the baseball to describe the greatest possible arc causes the baseball to have maximum velocity. Similarly, during a bowling swing, the Velcro patch is positioned on the wrist of the bowler's right (throwing) hand so that the patch covers the front or flat surface of the wrist. The coach or trainer instructs the athlete to aim the area of sensation produced by the pointed Velcro loops so that the throwing hand produces a proper vertical upward "lift" of the hand as it passes over the foul line and releases the ball. To use the wristband to aid in achieving a proper golf putting stroke, the wristband is placed so that the Velcro strip is pressed against the flat center portion of the back of the left wrist of a right-handed player. Using a conventional putting grip, the Velcro strip is aimed in the direction of the putt when the player and putter are properly aligned over the golf ball. The proper putting motion requires that the wrists be kept perfectly straight during the stroke, and that the shoulders "tilt" to produce the stroke, while the legs and hips remain motionless. If the player inadvertently flexes his wrist, the Velcro will produce an increased sensation, reminding him to keep the wrists straight. The sensation produced by the Velcro patch also enables the player to aim the back of the left wrist in the direction of the stroke, which is desirable. The increased sensation of the Velcro patch is a great help in enabling the player to avoid "hinging" of the wrists during the stroke, which is very undesirable, and enables him to produce a pendulum-like motion involving only the shoulders, straight arms, straight wrists, and the putter, which is very desirable.

BRIEF DESCRIPTION OF THE DRAWINGS

FIG. 1 is a perspective view of a preferred embodiment of the invention.

FIG. 2 is another perspective view of the device shown in FIG. 1.

FIG. 3 is a partial cutaway view of the device shown in FIG. 1.

FIG. 4 is a perspective view of another embodiment of the invention.

FIG. 5 is a partial cutaway perspective view useful in illustrating use of the wristband of FIG. 1.

FIG. 6 is a diagram useful in illustrating use of the wristband of FIG. 1 in instructing an athlete in the throwing of a "fast ball".

FIG. 7 is a diagram useful in illustrating use of the wristband of FIG. 1 in the proper swinging of a baseball bat.

FIG. 8 is a diagram useful in instructing an athlete in the use of the wristband of FIG. 1 to swing a golf club.

DESCRIPTION OF THE INVENTION

Referring now to the drawings, particularly FIGS. 1–3, the wristband 1 of the present invention includes a loop 2 of ordinary elastic material that is commonly used in the manufacture of wristbands which are available from Ridge View Mills, of Newton, N.C., and other major companies. Both the outer surface 3 and the inner surface 4 have a terry cloth type of texture which is soft and readily absorbs perspiration.

In accordance with the present invention, a strip 5 of Velcro material is attached to the inner surface 4 of wristband 1, and extends from one edge to the other thereof. Although it is optional, I have found that attachment of a separate differently colored strip of fabric 6 parallel to and adjacent to Velcro strip 5 on the outer surface 3, as best shown in FIG. 2, can sometimes be helpful in aiding an athlete to concentrate on "aiming"-his wrist in the direction in which his arm is to swing, and especially in properly orienting the Velcro inside so it contacts the desired portion of the skin. Velcro material includes a large number of small, plastic loops and hooks which engage each other when two pieces of Velcro material are pressed together to form a closure. I have found that use of a single piece of this material, when pressed against the skin, produces a stimulation that effectively directs the athlete's attention to the portion of his skin against which the piece of Velcro material is pressed. The elastic in the band 2 therefore must be sufficiently tensioned when the wristband is placed on the athlete's wrist to press the Velcro material against the skin of his wrist. The skin pressed against normally is either the skin that is over the "lead" end of the wrist bone of his left hand (assuming the athlete is right-handed), if it is desired to train the athlete in swinging a baseball bat or a golf club, or against the flat inner surface of his right wrist adjacent to the palm of his right hand, if it is desired to enable him or her to concentrate on proper throwing of a baseball or bowling ball.

The Velcro material which I have used has a stiff backing that tends to facilitate pressing of the ends of the Velcro loops and hooks against the athlete's skin. If desired, additional elastic strips such as 7, 8, and 9 in FIG. 3 can be provided in the elastic band 2 to increase the pressure of the Velcro material against the skin of the athlete's wrist. However, up to now I have found this expedient to be unnecessary.

The Velcro material which I have used is available from Velcro, of Montclair, N.J.

Next, the way in which the elastic wristband 1 is used in training or coaching a baseball player to properly swing a baseball bat 12 (FIG. 7) is explained. FIG. 5 shows the player's left hand 11 with wristband 1 properly in place. The cutaway portion of wristband 1 shows the Velcro strip 5 passing over the slightly protruding "lead" end of the wrist bone 10 of the player's wrist. The loops and hooks of the Velcro material 5 poke or dig into the skin over the end of the wrist bone enough to produce a distinct and constant stimulation or irritation, but cause no actual damage to the player's skin.

The player is coached and instructed to maintain the swing of the location of the stimulation, and hence, the location of the bat 12, level so that the tip of the bat moves through a planar arc during the entire swing and "follow-through". If the wrist of the left hand 11 "rolls" through the impact portion of the swing, the path of the "sweet spot" of the bat will be errant, reducing the likelihood of hitting the baseball solidly. (The "sweet spot" of a baseball bat is an area of approximately ¾ inch by 4½ inches located approximately 3 inches from the hitting end of the bat. If the "sweet spot" of the bat hits the baseball, maximum distance will be achieved.) Although coaches and athletes know this, applying this simple principle consistently is difficult because the athlete must concentrate on numerous other aspects of the game at the same time, such as maintaining the proper stance, focusing on the path of the pitched ball, making a split second decision whether to swing the bat, and achieving proper timing of the swing. I have found, in the course of experimental use of the wristband 1 in conjunction with my duties as a coach at a university, that there has been a very surprising improvement in the ability of most athletes to concentrate on keeping the wrist of their left hand oriented properly with the wristband 1 is worn in the manner described above, if the athlete is instructed in the fashion described above to point or aim the skin sensation area precisely in the proper direction during the swing. On a confidential basis, and with my permission, the wristband 1 has been used by several other coaches, including the coaching staff of the Phoenix Giants minor league baseball team. The reports that I have received indicate that the athletes who have used the wristband 1 generally find that it improves their ability to concentrate on the above-mentioned aspect of properly orienting their left wrist during swinging of a baseball bat. Several high school baseball coaches and little league baseball coaches have used the device and technique of the invention and report that it enables certain players to rapidly improve their batting averages.

I have also discovered that if the wristband 1 is positioned on an athlete's wrist in exactly the same position as described with reference to FIGS. 5 and 7, it can be used in the same manner to enable a golf player to properly swing a golf club 14 (FIG. 8). The proper swing of a golf club is essentially the same as the proper swing of a baseball bat, in that the entire swing of the club should follow the path of a planar arc. Rolling of the left wrist prior to or during contact of the club head with the golf ball will result in an undesired deviation of the golf club from the proper planar accurate path. I have found, in instructing students in swinging of a golf club, that they have difficulty in leading the "lead" end of the wrist bone of their left hand in such a manner as to accomplish proper circular upper body movement and a proper swing and proper bending of the righ knee, and that the stimulation provided by the Velcro patch 5 increases their ability to concentrate on this aspect of the swing.

To use the wristband to aid in achieving a proper golf putting stroke, the wristband is placed so that the Velcro strip is pressed against the flat center portion of the back of the left wrist of a right-handed player. Using a conventional putting grip, the Velcro strip will be aimed in the direction of the putt when the player and putter are properly aligned over the golf ball. The proper putting motion requires that the wrists be kept perfectly straight during the stroke, and that the shoulders tilt to produce the stroke, while the legs and hips remain motionless. If the player inadvertently flexes his wrist, the Velcro will produce an increased sensation, reminding him to keep the wrists straight. The sensation produced by the Velcro patch also enables the player to aim the back of the left wrist in the direction of the stroke, which is desirable. The increased sensation of the Velcro patch is a great help in enabling the player to avoid "hinging" of the wrists during the stroke, which is very undesirable, and enables him to produce a pendulum-like motion involving only the shoulders, straight arms, straight wrists, and the putter, which is very desirable.

By shifting the position of the wristband 1 so that the Velcro patch 5 presses against the inner or "front" flat area 20 adjacent to the palm of a right-handed person, as shown in FIG. 6, the resulting stimulation of the skin will enable the athlete to aim the front area 20 of his wrist in such a way as to improve the pitching of an overhand "fast ball". In FIG. 6, reference numeral 14 designates a baseball held in an athlete's right hand 13. To properly throw an overhand fast ball, the area 20 of the player's wrist should be aimed directly toward the target or the catcher during the throw until the stride foot lands, causing the arm to "hurl" rather than "push" the baseball. To instruct the user to perform a proper "windup", the coach or trainer instructs the pitcher (right-handed) to pivot his body clockwise (as viewed from above), lift his left knee upward toward the middle of his chest, and at the same time extend the right hand and the baseball straight out and rearward to a point below the waist level and then up to a level halfway between the shoulder level and waist level, so that the Velcro strip and sensation produced thereby is aimed downward at the ground. This ensures maximum possible extension of the pitcher's arm, and a maximum arc of the arm and the ball during the next phase of the throwing motion. The pitcher then points the toes of the left foot at the target as he lowers his left foot solidly on the ground in front of the pitcher's mound, rotating the hips, shoulders, and upper arm counterclockwise and forward, with the forearm, right hand and baseball lagging behind. As the motion progresses, the arm action is much like that of a slingshot, and the hand and baseball are delivered past and above the head level. The coach or trainer instructs the athlete to aim the area of skin sensation produced by the "pointed" Velcro hooks and loops forward toward the target at this point of the throwing motion. The fact that this technique causes the hand and the baseball to describe the greatest possible arc causes the baseball to have maximum velocity. Similarly, during a bowling swing, the Velcro patch is positioned on the wrist of the bowler's right (throwing) hand so that the patch covers the front or flat surface of the wrist. The coach or trainer instructs the athlete to aim the area of sensation produced by the pointed Velcro loops that the throwing hand produce a proper vertical upward "lift" of the hand as it passes over the foul line and releases the ball.

Again, athletes frequently fail to maintain the proper wrist orientation during pitching of an overhand fast ball because of the difficulty in concentrating on this as well as many other aspects of a proper pitching motion. The stimulation provided by the Velcro patch 5 increases the athelete's ability to concentrate on the above-mentioned aspects of the proper throwing motion.

In the proper motion of a bowler's right hand the wrist area adjacent to the palm of the bowler's hand should "lift" the bowling ball, and there should be no "hinging" of the wrist of the throwing hand. I have found that concentrating on this aspect simultaneously with concentrating on the many other aspects of a proper throw of a bowling ball is difficult for most people, and again, the stimulation provided by the Velcro patch on the wrist area adjacent to the palm of the user's hand generally improves the user's concentration on these aspects and hence improves the accuracy of the bowling ball. Of particular importance is that the Velcro patch tends to pinch or scrape the wrist skin if the person improperly "hinges" his or her wrist during the end of the swing and reminds the person to keep the wrist straight.

An alternate embodiment of the invention is shown in FIG. 4, in which an elastic wristband 15 has a Velcro patch 19 on the outer surface of a strip of elastic material 16, a Velcro patch 5 attached to the inner surface in the same manner as described with reference to FIG. 1, and has an outer closure strip 17 with Velcro material 18 inside it. This expedient allows the tension of the elastic band to be adjusted, if desired to increase or decrease the pressure of the Velcro patch 5 against the user's skin.

While the invention has been described with reference to a particular embodiment thereof, those skilled in the art will be able to make various modifications to the described embodiment of the invention without departing from the true spirit and scope thereof.

I claim:

1. A method for adding a person in maintaining proper orientation of a person's first hand during a swinging motion of the person's first hand, said method comprising the steps of:

(a) placing an elastic wristband on the wrist of the first hand;

(b) orienting the elastic wristband so that a relatively small section of skin-stimulating material attached to the inner surface of the wristband is pressed against a predetermined portion of the skin of the wrist;

(c) causing the skin-stimulating material to poke the skin with sufficient force to produce a stimulation sensation that is capable of focusing the person's attention to the portion of the skin pressed against during the swinging motion; and (d) focusing his or her attention on the area of skin so stimulated during swinging of the person's arm and first hand and aiming the stimulated skin in a certain manner during the swinging motion.

2. The method of claim 1 wherein the person's first hand grasps a club near an inner end thereof and the person's other hand grasps the club on an outer portion thereof relative to the portion grasped by the first hand, and wherein step (a) includes positioning the skin-stimulating material against skin covering the lead end of the wrist bone of the person's first hand and includes causing the person to aim the stimulated skin in the direction of the first hand through a planar arc while holding the club.

3. The method of claim 2 wherein the club is a baseball bat.

4. The method of claim 2 wherein the club is a golf club.

5. The method of claim 1 wherein the club is a golf putter, and wherein the skin-stimulating material is pressed against the skin of the wrist adjacent to the palm of the first hand of the person, the method including aiming the stimulated skin parallel to the arc of the swing of the golf putter.

6. The method of claim 1 wherein the first hand grips a ball to be thrown, the method including placing the skin-stimulating material against the skin of the wrist adjacent to the palm of the first hand.

7. The method of claim 6 wherein the ball is a baseball, the method including aiming the stimulated skin in the direction of a target during a throwing motion.

8. The method of claim 6 wherein the ball is a bowling ball, the method including aiming the stimulated skin in the direction of the target bowling pins during the swing and delivery of the bowling ball.

9. The method of claim 1 wherein the predetermined portion of the wrist skin is the flat portion of the wrist skin adjacent to the palm of the hand, wherein undesirable flexing of the wrist during swing of the arm results in an increased sensation that reminds the person to keep the wrist straight.

* * * * *